US007628452B2

(12) United States Patent
Du et al.

(10) Patent No.: US 7,628,452 B2
(45) Date of Patent: Dec. 8, 2009

(54) ROCKER BASE

(75) Inventors: Guoliang Du, Shanghai (CN); Jianjun Hu, Hangzhou (CN); Paul Lin Chen, Naperville, IL (US)

(73) Assignee: Shanghai Industries Group, Ltd., Shanghai (CN)

( * ) Notice: Subject to any disclaimer, the term of this patent is extended or adjusted under 35 U.S.C. 154(b) by 0 days.

(21) Appl. No.: 12/040,822

(22) Filed: Feb. 29, 2008

(65) Prior Publication Data

US 2009/0218862 A1 Sep. 3, 2009

(51) Int. Cl.
*A47C 3/02* (2006.01)
*A47C 3/027* (2006.01)

(52) U.S. Cl. ..... 297/259.2; 297/265.1; 297/DIG. 7

(58) Field of Classification Search ..... 297/259.2, 297/259.1, 265.1, 264.1, 271.6, 258.1, DIG. 7
See application file for complete search history.

(56) References Cited

U.S. PATENT DOCUMENTS

| | | | |
|---|---|---|---|
| 296,931 | A | 4/1884 | Cupp |
| 665,005 | A | 1/1901 | Harmon |
| 1,682,685 | A | 8/1928 | Rodery |
| 1,986,233 | A | 1/1935 | Weaver |
| 2,772,723 | A | 12/1956 | Tunnel |
| 2,871,916 | A | 2/1959 | Fox |
| 2,963,077 | A | 12/1960 | Knabusch et al. |
| 3,093,409 | A | 6/1963 | Fletcher |
| 3,141,700 | A | 7/1964 | Fletcher |
| 3,158,877 | A | 12/1964 | Cooper |
| 3,162,483 | A | 12/1964 | Fletcher |
| 3,163,464 | A | 12/1964 | Martin et al. |
| 3,190,693 | A | 6/1965 | Underdown, Sr. |
| 3,243,226 | A | 3/1966 | Katz |
| 3,279,847 | A | 10/1966 | Ré |
| 3,300,244 | A | 1/1967 | Hughes |
| 3,302,969 | A | 2/1967 | Mizelle et al. |
| 3,339,971 | A | 9/1967 | Fletcher |

(Continued)

FOREIGN PATENT DOCUMENTS

| | | |
|---|---|---|
| JP | 01238140 | 9/1989 |

(Continued)

*Primary Examiner*—Milton Nelson, Jr.
(74) *Attorney, Agent, or Firm*—James P. Muraff; Neal, Gerber & Eisenberg LLP

(57) ABSTRACT

The present invention relates to a furniture support structure, and more particularly to a base for supporting a rocking chair. The rocker base has a lower frame, an upper frame, and a plurality of cams. The lower frame has a plurality of lower U-shaped cross members connected to a plurality of side rails, and a plurality of lower spring mounts extending between the lower cross members and connected to the side rails. The upper frame has a plurality of upper U-shaped cross members connected to a plurality of L-shaped side brackets, and a plurality of upper spring mounts extending between the upper cross members and connected to the L-shaped side brackets. The plurality of cams have an arcuate lower surface positioned against the side rails and a flat upper surface attached to the L-shaped side brackets. The cams are compressibly loaded between the side rails and the L-shaped side brackets. The upper spring mounts are inwardly offset from a vertical portion of the L-shaped side brackets to avoid all fasteners joining the cams to the L-shaped side brackets.

20 Claims, 10 Drawing Sheets

U.S. PATENT DOCUMENTS

| | | | | | |
|---|---|---|---|---|---|
| 3,464,736 | A | | 9/1969 | Mizzelle | |
| RE27,231 | E | | 11/1971 | Fletcher | |
| 3,637,255 | A | | 1/1972 | Ré | |
| 3,730,585 | A | | 5/1973 | Rogers, Jr. et al. | |
| 3,747,973 | A | | 7/1973 | Ré | |
| 3,767,257 | A | | 10/1973 | Rogers, Jr. et al. | |
| 3,802,735 | A | | 4/1974 | Ré | |
| 3,815,954 | A | | 6/1974 | Rogers, Jr. et al. | |
| 3,895,840 | A | * | 7/1975 | Szurszewski | 297/230.11 |
| 3,904,240 | A | | 9/1975 | Rogers, Jr. et al. | |
| 3,938,857 | A | | 2/1976 | Craig | |
| 3,966,251 | A | | 6/1976 | Belisle | |
| 4,057,289 | A | | 11/1977 | Jones | |
| 4,071,276 | A | | 1/1978 | Cecil | |
| 4,079,931 | A | * | 3/1978 | Valentine et al. | 482/65 |
| 4,179,157 | A | | 12/1979 | Shoemaker et al. | |
| 4,212,494 | A | | 7/1980 | Dabney | |
| 4,285,543 | A | * | 8/1981 | Clark | 297/272.1 |
| 4,519,647 | A | | 5/1985 | Rogers, Jr. et al. | |
| 4,601,513 | A | | 7/1986 | Pine | |
| 4,637,081 | A | * | 1/1987 | Clark | 5/18.1 |
| 4,707,025 | A | | 11/1987 | Rogers, Jr. et al. | |
| 4,811,073 | A | | 3/1989 | Kitamura et al. | |
| 4,868,630 | A | | 9/1989 | Tanizawa et al. | |
| 4,883,980 | A | | 11/1989 | Morimoto et al. | |
| 4,920,398 | A | | 4/1990 | Yoshio et al. | |
| RE33,704 | E | | 10/1991 | Rogers, Jr. et al. | |
| 5,060,046 | A | | 10/1991 | Shintani | |
| 5,121,967 | A | | 6/1992 | Rogers | |
| 5,171,000 | A | | 12/1992 | LaPointe et al. | |
| 5,370,442 | A | | 12/1994 | Saul et al. | |
| 5,435,622 | A | | 7/1995 | Fay et al. | |
| 5,490,714 | A | | 2/1996 | de Santis | |
| 5,839,781 | A | | 11/1998 | Knape | |
| 6,000,750 | A | | 12/1999 | Rossman et al. | |
| 6,000,754 | A | | 12/1999 | Lawson | |
| 6,287,482 | B1 | | 9/2001 | Hamura et al. | |
| 6,918,632 | B2 | | 7/2005 | Maki et al. | |
| 7,150,087 | B2 | | 12/2006 | Maki et al. | |
| 7,252,334 | B2 | | 8/2007 | Hale et al. | |
| 7,328,949 | B2 | * | 2/2008 | Donovan et al. | 297/259.2 |

FOREIGN PATENT DOCUMENTS

| | | |
|---|---|---|
| JP | 03147349 | 6/1991 |

* cited by examiner

ROCKER BASE

CROSS REFERENCE TO RELATED APPLICATIONS

None.

FIELD OF THE INVENTION

The present invention relates to a furniture support structure, and more particularly to a base for supporting a rocking chair.

SUMMARY OF THE INVENTION

The present invention is directed to a rocker base for a rocker-recliner chair. In one embodiment, the rocker base has a lower frame, an upper frame, and a plurality of cams. The lower frame has a plurality of lower U-shaped cross members connected to a plurality of side rails, and a plurality of lower spring mounts extending between the lower cross members and connected to the side rails. The upper frame has a plurality of upper U-shaped cross members connected to a plurality of L-shaped side brackets, and a plurality of upper spring mounts extending between the upper cross members and connected to the L-shaped side brackets. The plurality of cams have an arcuate lower surface positioned against the side rails and a flat upper surface attached to the L-shaped side brackets. The cams are compressibly loaded between the lower frame and the upper frame. The upper spring mounts are inwardly offset from a vertical portion of the L-shaped side brackets to avoid all fasteners joining the cams to the L-shaped side brackets.

A better understanding of the objects, advantages, features, properties and relationships of the invention will be obtained from the following detailed description and accompanying drawings which set forth illustrative embodiments that are indicative of the various ways in which the principles of the invention may be employed.

BRIEF DESCRIPTION OF THE DRAWINGS

The invention is described in more detail by reference to the drawings, in which.

DETAILED DESCRIPTION

Figure 1:
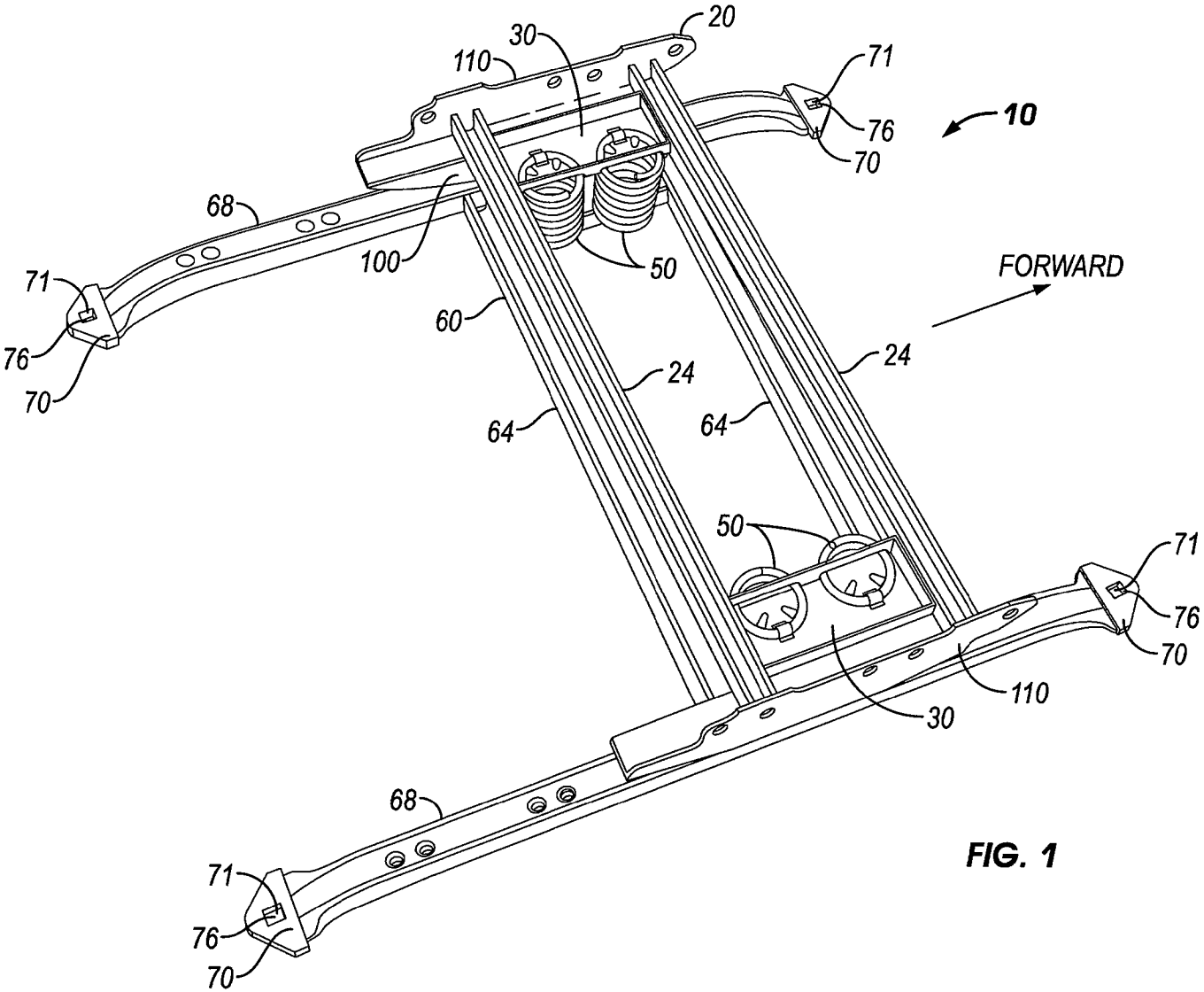
FIG. 1 illustrates a top perspective view of one embodiment of the present invention.

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing. All publications, patents and applications cited in this specification are herein incorporated by reference as if each individual publication, patent or application had been expressly stated to be incorporated by reference.

Turning now to the figures, wherein like reference numerals refer to like elements, there is illustrated in FIGS. 1-12 rocker base 10 embodying the improvements of the present invention.

Figure 2:
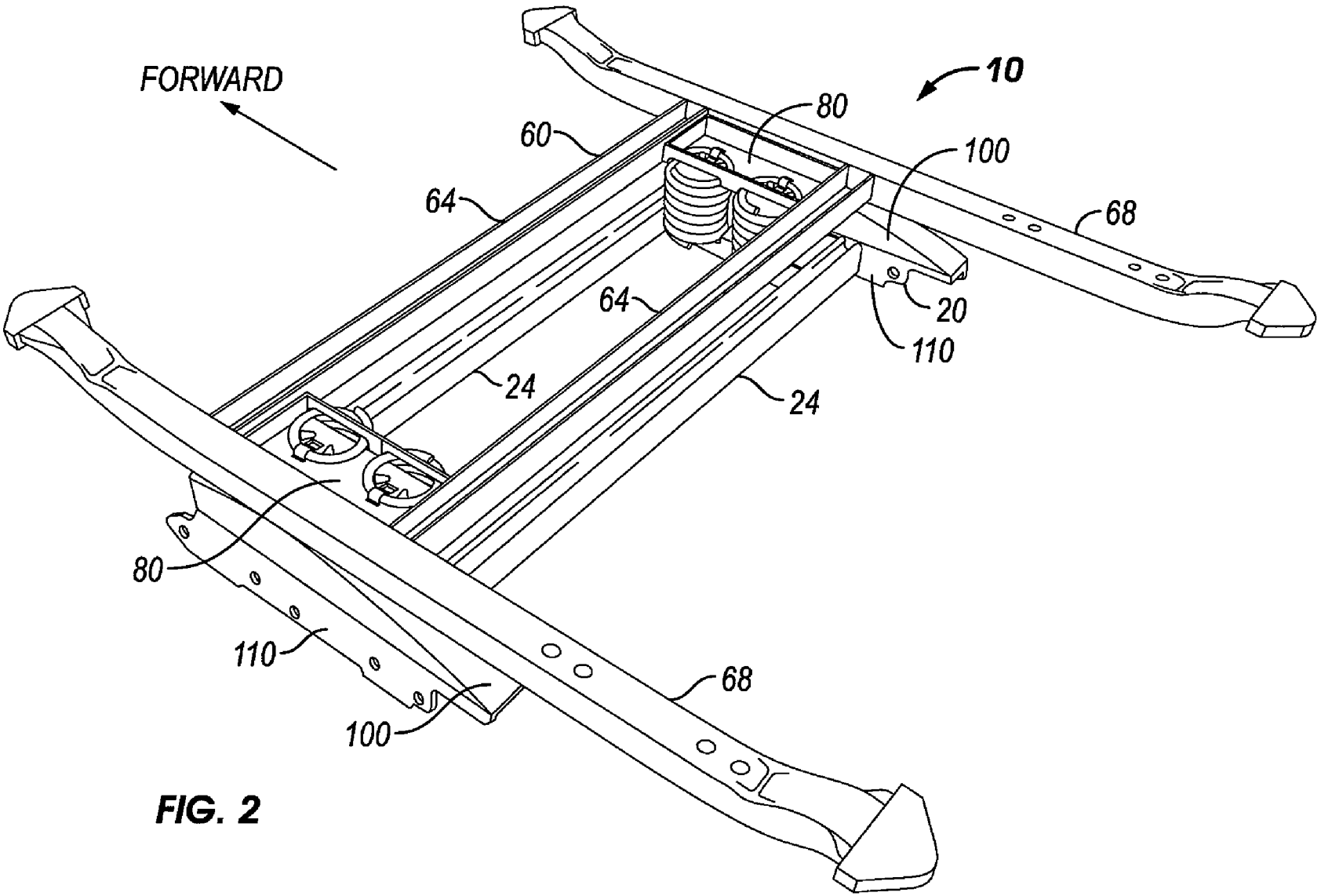
FIG. 2 illustrates a bottom perspective view of the embodiment shown in FIG. 1.
Figure 3:
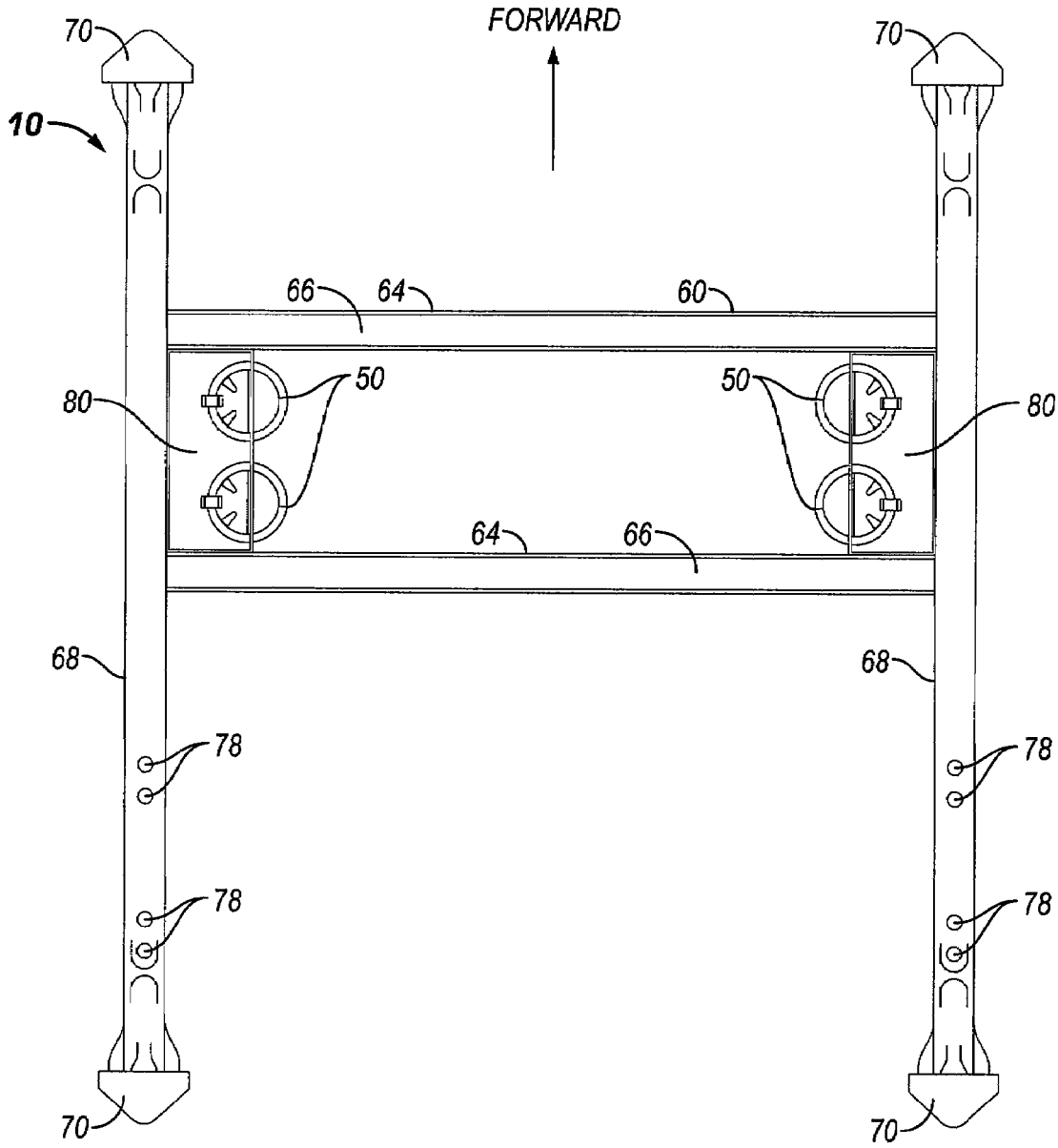
FIG. 3 illustrates a bottom plan view of the embodiment shown in FIG. 1.

Referring to FIGS. 1-2, rocker base 10 may include upper frame assembly 20, lower frame assembly 60, and a plurality of springs 50 positioned therebetween for supporting and operating a conventional rocker/recliner chair.

As shown in FIG. 1, upper frame assembly 20 may include a plurality of upper U-shaped cross members 24 extending laterally between, and be connected to, a plurality of L-shaped side brackets 110. Upper frame assembly 20 may also include a plurality of upper spring mounts 30, each extending between respective pairs of upper U-shaped cross members 24 and connected to an L-shaped side bracket 110. Upper U-shaped cross members 24 may be welded to L-shaped side brackets 110. Although welding is known to reduce weight of a finished article as compared to other known fastening methods, it should be understood, however, that other fastening methods known to one of ordinary skill in the art may be employed to secure upper U-shaped cross members 24 to L-shaped side brackets 110.

Upper U-shaped cross members 24 may be oriented such that the open portion 26 of the "U" may be oriented upward toward the chair. However, open portion 26 may be oriented in any direction, such as, upward, forward, rearward, or downward. In addition, open portion 26 of each upper U-shaped cross member 24 may be oriented in different directions from one another.

Upper U-shaped cross members 24 and L-shaped side brackets 110 may be made from a heavy gauge steel, or any other material that provides suitable strength, rigidity and life for its intended purpose. To minimize manufacturing and material costs, upper U-shaped cross members 24 may be formed as extrusions using an extrusion process. Alternatively, upper U-shaped cross members 24 may be formed as stampings using a stamping process or as roll-formings using a roll-forming process. In addition, to further minimize material costs and to minimize weight (which may affect shipping costs of rocker base 10) without sacrificing strength, upper U-shaped cross members 24 may be configured in a U-shaped cross-section from end to end rather than as a tubular or polygonal cross section.

Upper spring mounts 30 may each include at least inside wall 32, outside wall 34, and anchor panel 40. Outside wall 34 may be connected to an L-shaped side bracket 110, and anchor panel 40 may be connected to respective forward and after upper U-shaped cross members 24. To add rigidity and torsional stability to upper frame assembly 20 while promoting manufacturing ease, as shown in the figures, the plurality of upper spring mounts 30 may each comprise a shallow, four-sided tray made of heavy gauge steel comprising inside wall 32, outside wall 34, forward wall 36, rear wall 38, and anchor panel 40. Forward wall 36 and rear wall 38 may be connected to respective forward and aft upper U-shaped cross members 24.

Upper spring mounts 30 may be formed by bending plate steel along four edges to create the rectangular plan form shown in the figures. Alternatively, upper spring mounts 30 may be formed by welding inside wall 32, outside wall 34, forward wall 36, and rear wall 38 to anchor panel 40 to form the shallow tray described above.

Upper spring mounts 30 may be welded to upper U-shaped cross members 24 along forward wall 36 and rear wall 38 of upper spring mounts 30. In addition, upper spring mounts 30 may be welded to and along an inside edge of L-shaped side brackets 110 by inwardly offsetting upper spring mounts 30 away from the vertical portion of L-shaped side brackets 110. Although welding is known to reduce weight of a finished article as compared to other known fastening methods, it should be understood, however, that other fastening methods known to one of ordinary skill in the art may be employed to secure upper spring mounts 30 to upper U-shaped cross members 24 and/or L-shaped side brackets 110.

Figure 9:
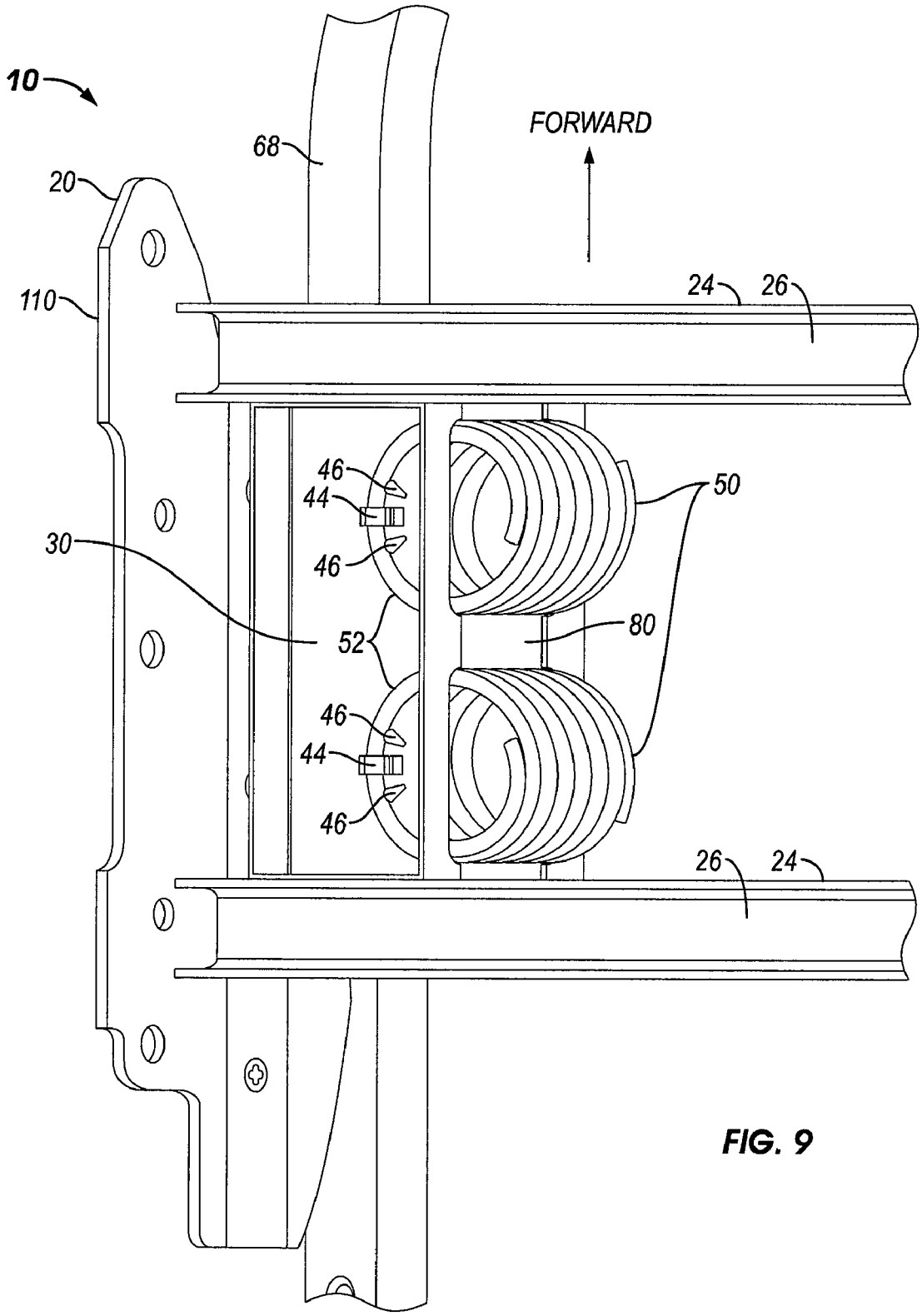
FIG. 9 illustrates a top perspective detail view of the embodiment shown in FIG. 1.
Figure 10:
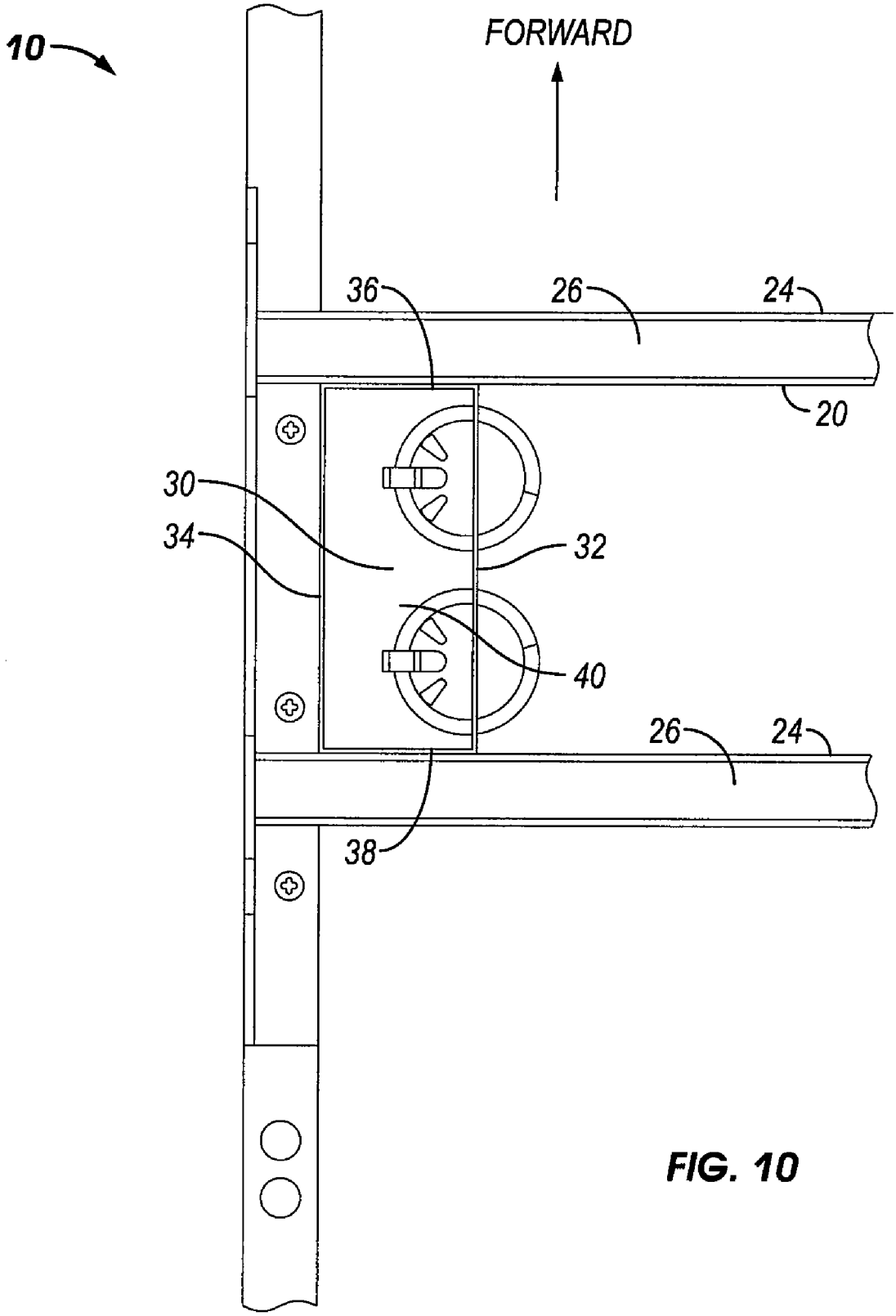
FIG. 10 illustrates a top detail view of the embodiment shown in FIG. 1.
Figure 11:
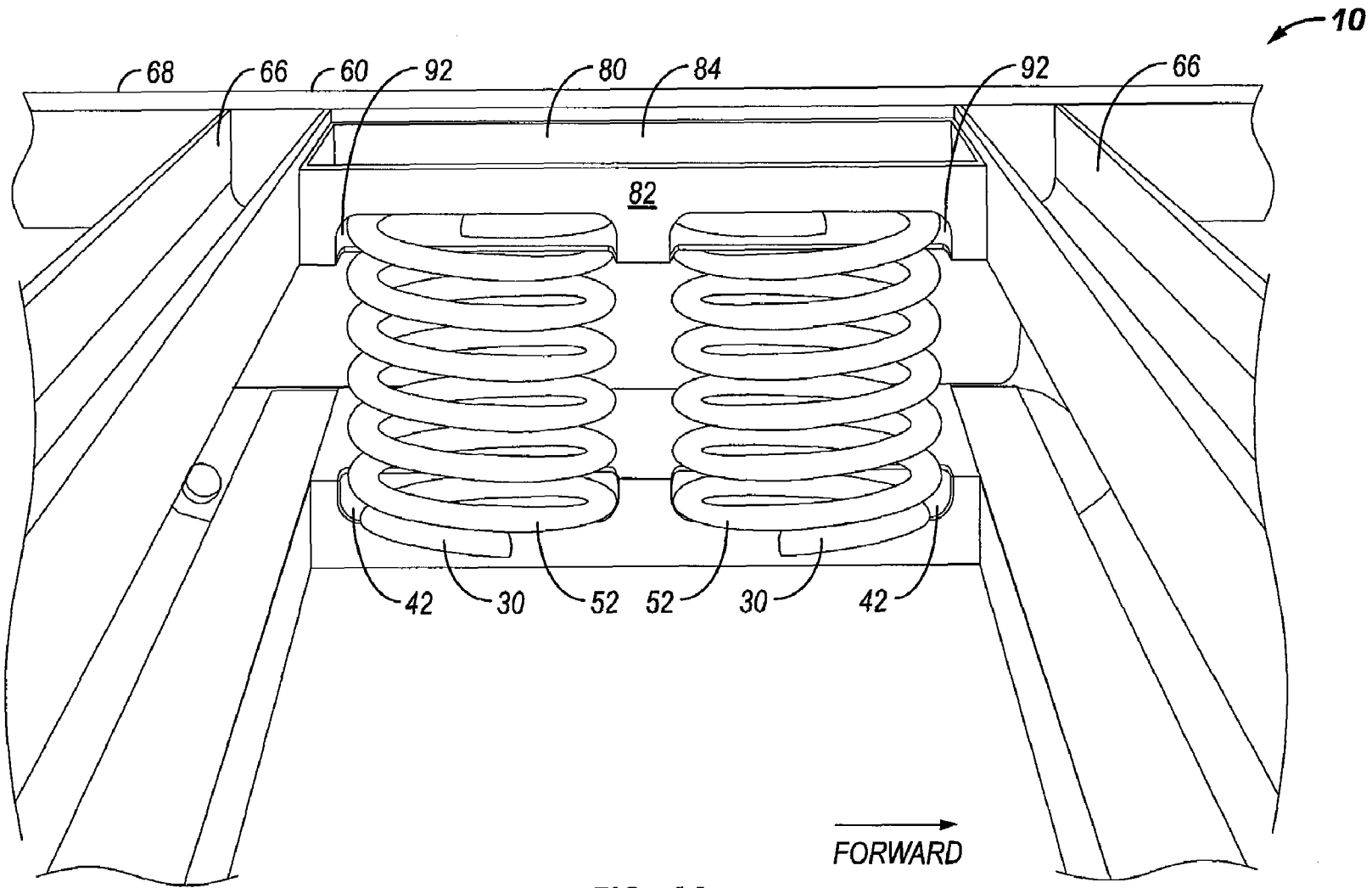
FIG. 11 illustrates a bottom perspective detail view of the embodiment shown in FIG. 1; and, FIG. 12 illustrates another bottom perspective detail view of the embodiment shown in FIG. 1.

As shown in FIGS. 9 and 11, upper spring mounts 30 may include a one or more apertures 42 formed in inside wall 32 for receiving and mounting one or more springs 50. Upper spring mounts 30 may also include a plurality of spring anchors 44 and spring nubs 46 formed in anchor panel 40, as best shown in FIG. 9, for securing springs 50 to upper spring mounts 30. Spring anchors 44 may be formed by slicing anchor panel 40 in the shape of an elongated "U" in bending and forming the tab that results around one or more coils of springs 50. Spring nubs 46 may provide secondary securement of springs 50 to upper spring mounts 30 in addition to spring anchors 44.

Figure 4:
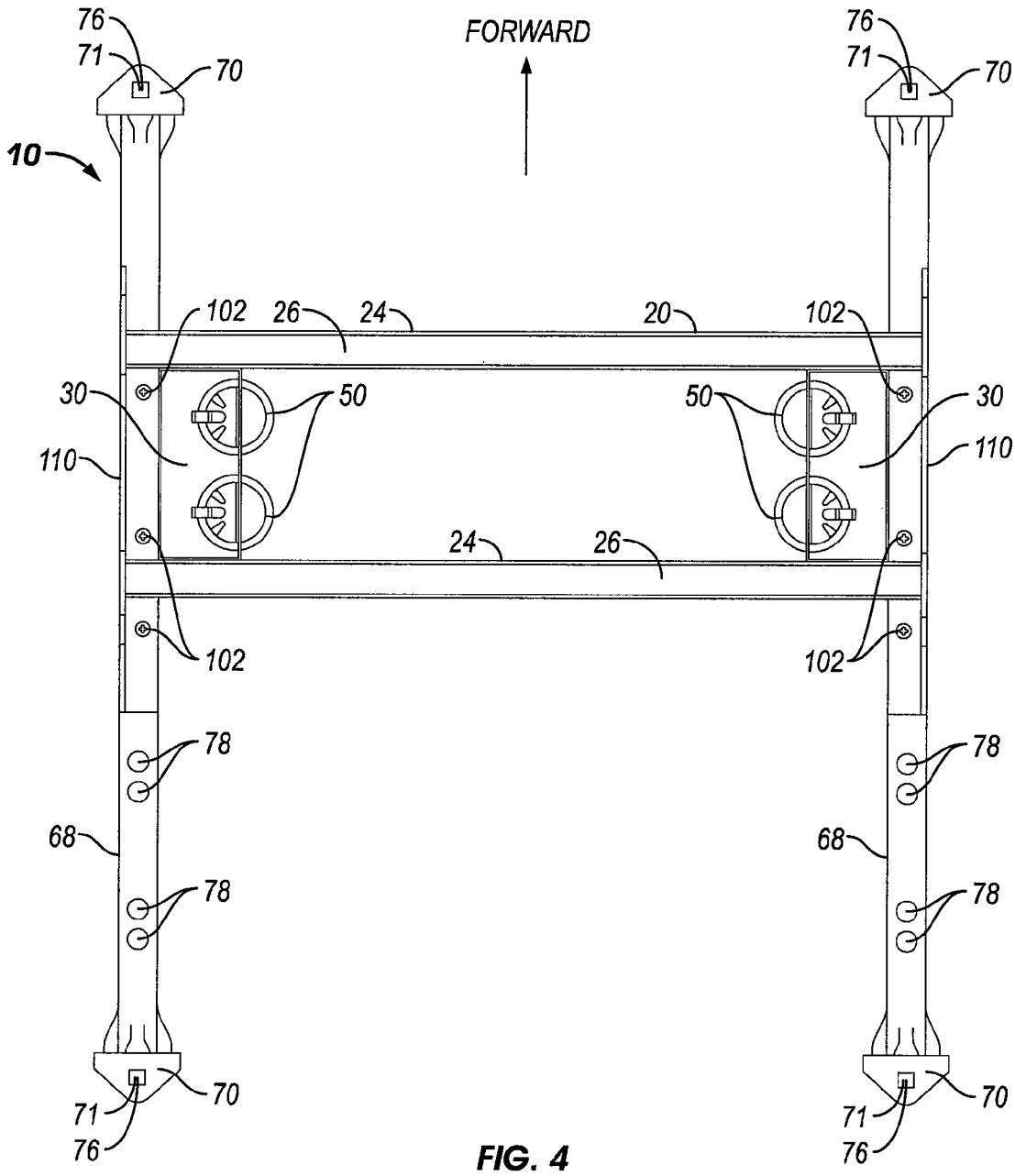
FIG. 4 illustrates a top plan view of the embodiment shown in FIG. 1.
Figure 6:
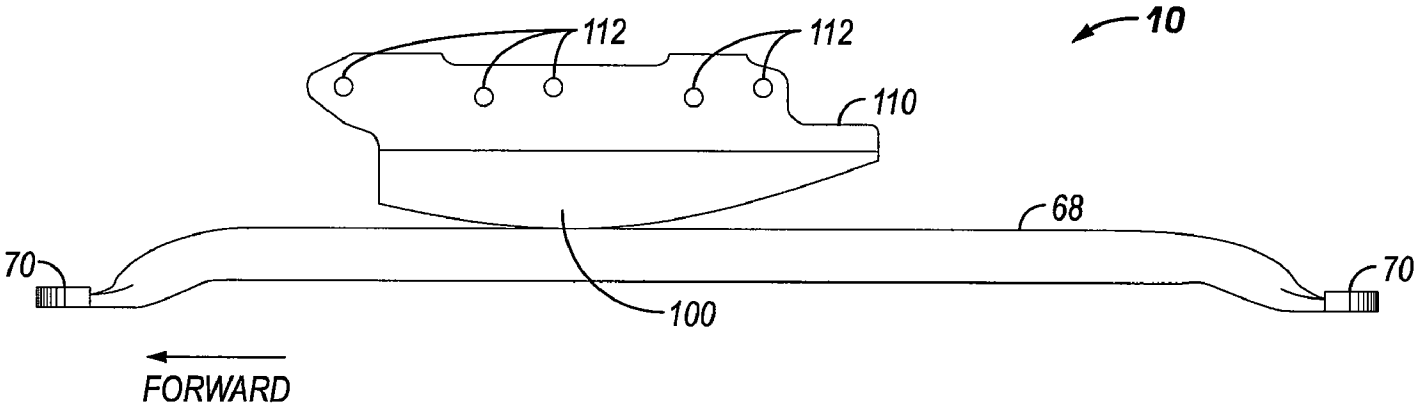
FIG. 6 illustrates a left side elevation view of the embodiment shown in FIG. 1.
Figure 7:
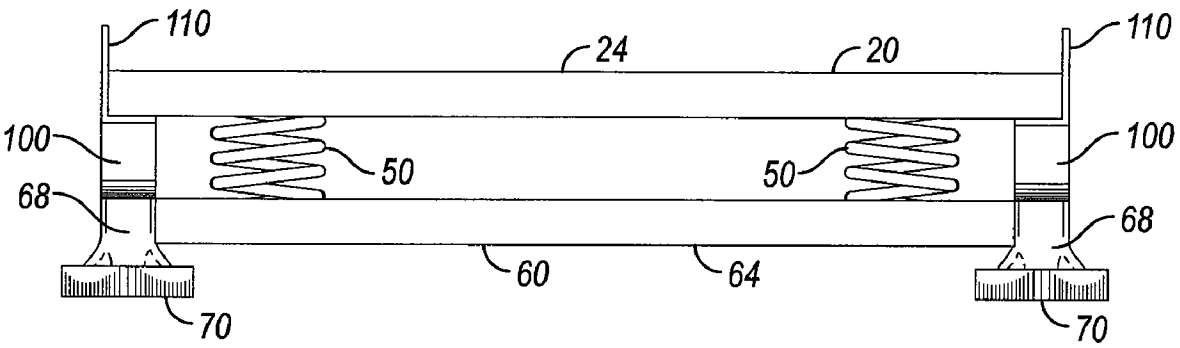
FIG. 7 illustrates a rear elevation view of the embodiment shown in FIG. 1.
Figure 8:
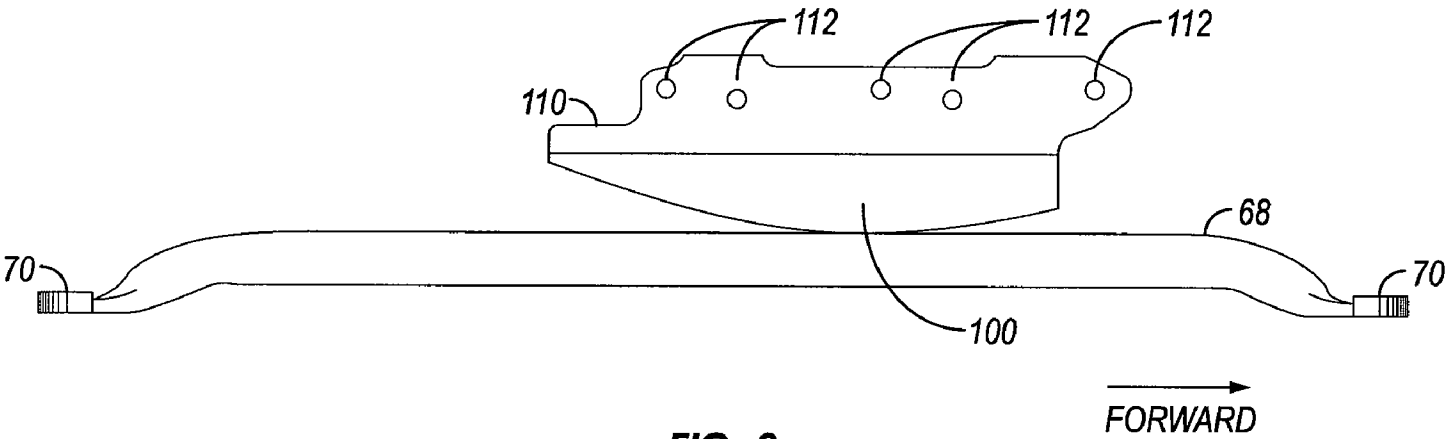
FIG. 8 illustrates a right side elevation view of the embodiment shown in FIG. 1.

To enable a rocker/recliner chair to rock back and forth when mounted to rocker base 10, upper frame assembly 20 may include a plurality of cams 100, as best shown in FIGS. 6 and 8. Each cam 100 may have an arcuate lower surface positioned against respective side rails 68 of lower frame assembly 60, and a flat upper surface attached to a bottom surface of L-shaped side bracket 110. Cams 100 may be manufactured from any suitably stiff material such as wood, plastic, aluminum, or steel, for example. As shown in FIG. 4, cams 100 may be secured to L-shaped side brackets 110 using a plurality of fasteners 102. It should be understood, however, that other fastening methods known to one of ordinary skill in the art may be employed to secure cams 100 to L-shaped side brackets 110.

Referring again to FIG. 2, lower frame assembly 60 may comprise a plurality of lower U-shaped cross members 64 extending laterally between, and connected to, a plurality of side rails 68. Lower frame assembly 60 may also include a plurality of lower spring mounts 80 extending between respective pairs of lower U-shaped cross members 64 and connected to respective side rails 68. Side rails 68 may be positioned transverse to upper and lower U-shaped cross members 24, 64. Lower U-shaped cross members 64 may be welded to side rails 68. Although welding is known to reduce weight of a finished article as compared to other known fastening methods, it should be understood, however, that other fastening methods known to one of ordinary skill in the art may be employed to secure lower U-shaped cross members 64 to side rails 68.

Lower U-shaped cross members 64 may be oriented such that the open portion 66 of the "U" may be oriented downward toward the floor. However, open portion 66 may be oriented in any direction, such as, upward, forward, rearward, or downward. In addition, open portion 66 of each lower U-shaped cross member 64 may be oriented in different directions from one another. Lower U-shaped cross members 64 may be made from a heavy gauge steel, or any other material that provides suitable strength, rigidity and life for its intended purpose.

Lower U-shaped cross members 64 and side rails 68 may be made from a heavy gauge steel, or any other material that provides suitable strength, rigidity and life for its intended purpose. To minimize manufacturing and material costs, lower U-shaped cross members 64 and side rails 68 may be formed as extrusions using an extrusion process. Alternatively, side rails 68 may be formed as seamless tubes or as welded tubes.

In addition, to further minimize material costs and to minimize weight (which may affect shipping costs of rocker base 10) without sacrificing strength, lower U-shaped cross members 64 may be configured in a U-shaped cross-section from end to end rather than as a tubular or polygonal cross section. As shown in the figures, side rails 68 may be configured to have a generally square cross section, however, side rails 68 may be configured to have other open or closed cross-sectional shapes, such as U-shaped, tubular, rectangular, etc.

Lower spring mounts 80 may each include at least inside wall 82, outside wall 84, and anchor panel 90. Outside wall 84 may be connected to a side rail 68, and anchor panel 90 may be connected to respective forward and after lower U-shaped cross members 64. To add rigidity and torsional stability to lower frame assembly 60 while promoting manufacturing ease, as shown in the figures, the plurality of lower spring mounts 80 may each comprise a shallow, four-sided tray made of heavy gauge steel comprising inside wall 82, outside wall 84, forward wall 86, rear wall 88, and anchor panel 90. Forward wall 86 and rear wall 88 may be connected to respective forward and aft lower U-shaped cross members 64.

Lower spring mounts 80 may be formed by bending plate steel along four edges to create the rectangular plan form shown in the figures. Alternatively, lower spring mounts 80 may be formed by welding inside wall 82, outside wall 84, forward wall 86, and rear wall 88 to anchor panel 90 to form the shallow tray described above.

Lower spring mounts 80 may be welded to lower U-shaped cross members 64 along forward wall 86 and rear wall 88 of lower spring mounts 80. In addition, lower spring mounts 80 may be welded to side rails 68. Although welding is known to reduce weight of a finished article as compared to other known fastening methods, it should be understood, however, that other fastening methods known to one of ordinary skill in the art may be employed to secure lower spring mounts 80 to lower U-shaped cross members 64 and/or side rails 68.

Figure 12:
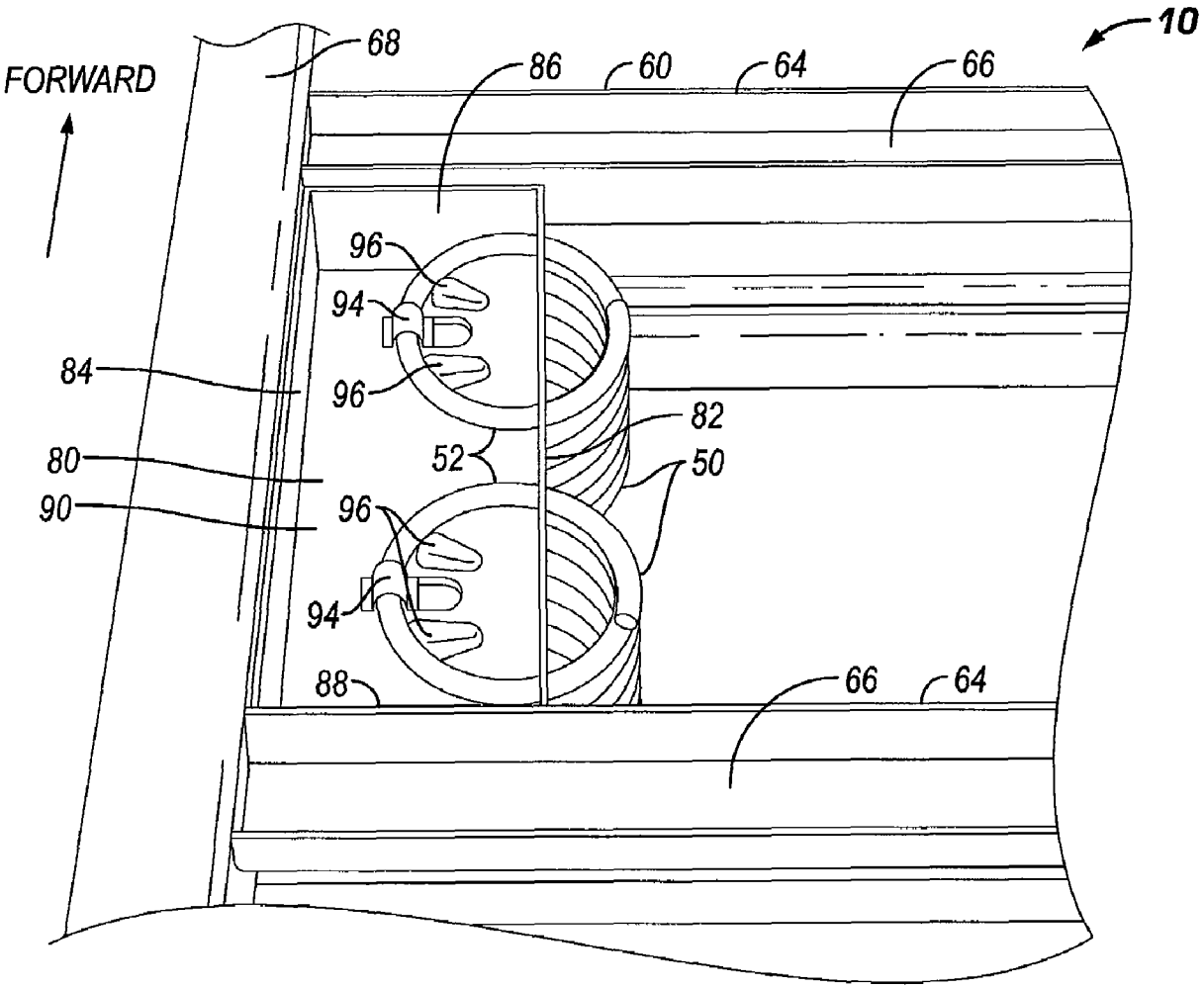

As shown in FIGS. 11-12, lower spring mounts 80 may include one or more apertures 92 formed in inside wall 82 for receiving and mounting one or more springs 50. Lower spring mounts 80 may also include a plurality of spring anchors 94 and spring nubs 96 formed in anchor panel 90, as best shown in FIG. 12, for securing springs 50 to lower spring mounts 80.

Spring anchors 94 may be formed by slicing anchor panel 90 in the shape of an elongated "U" in bending and forming the tab that results around one or more coils of springs 50. Spring nubs 96 may provide secondary securement of springs 50 to lower spring mounts 80 in addition to spring anchors 94.

Referring to FIGS. 1-4, side rails 68 of lower frame assembly 60 may include shoes 70 positioned over each end of side rails 68 to provide a non-marring contact surface where rocker base 10 meets a floor or supporting surface. To create feet for supporting rocker base 10 and to accommodate shoes 70, each end of side rails 68 may be bent and/or flattened using, for example, a hydraulic press, to form the "S" profile shown in FIGS. 6 and 8.

Shoes 70 may comprise any one of a number of materials that have non-marring qualities, such as rubber or rubberized materials, elastomerics, and the like. In addition, shoes 70 may be configured, using materials, geometry, or both, to have sufficient friction between rocker base 10 and the floor or supporting surface to prevent slippage and unwanted or unintended movement of rocker base 10 relative to the floor or supporting surface during operation of a rocker/recliner chair mounted to rocker base 10.

Shoes 70 may be secured to each end of each side rail 68 using, for example, frictional forces between mating internal and external surfaces of shoes 70 and side rails 68, respectively. In addition or alternatively, shoes 70 may be secured to side rails 68 using adhesives, fasteners, or by a positive retention mechanism. One such positive retention mechanism is shown in FIGS. 1 and 4. For example, respective ends of side rails 68 may include ramps or wedges 76 for receiving receptacles 71 on shoes 70. To install and positively retain shoes 70 onto side rails 68, shoes 70 may be pushed onto, and elastically deformed over, respective ends of side rails 68 until ramps or wedges 76 of shoes 70 engages receptacles 71.

When viewed from the top, as shown in FIG. 4, upper frame assembly 20 may be positioned atop lower frame assembly 60 such that respective fore and aft upper U-shaped cross members 24 may be positioned directly above respective fore and aft lower U-shaped cross members 64. Similarly, respective upper spring mounts 30 may be positioned directly above respective lower spring mounts 80. As shown in the figures, the size and geometry of upper spring mounts 30 may be approximately equal to the size and geometry of lower spring mounts 80. However, though upper U-shaped cross members 24 may have the same geometry as lower U-shaped cross members 64, upper U-shaped cross members 24 are necessarily longer than lower U-shaped cross members 64 due to the geometry and position of L-shaped side brackets 110.

As shown in FIGS. 5-8, cams 100 may be compressibly loaded between side rails 68 of lower frame assembly 60 and L-shaped brackets 110 of upper frame assembly 20 by tensioning springs 50. In this way, springs 50 may cause a return force to be exerted on upper frame assembly 20 whenever upper frame assembly 20 is rocked fore and aft of the neutral position shown in each of FIGS. 1-12. In addition, coils 52 of respective springs 50 that are mounted on respective pairs of upper and lower spring mounts 30,80 may be oriented in opposite directions (i.e., clockwise and counter-clockwise) to help insure symmetrical loading of lower frame assembly 60 and upper frame assembly 20. Thus, for example, a forward spring 50 may be coiled in the counterclockwise direction when viewing rocker base 10 from above, as in FIG. 4, while an adjacent, aft spring 50 may be coiled in the clockwise direction. This orientation of coils may be mirrored on the opposite side of rocker base 10.

Figure 5:
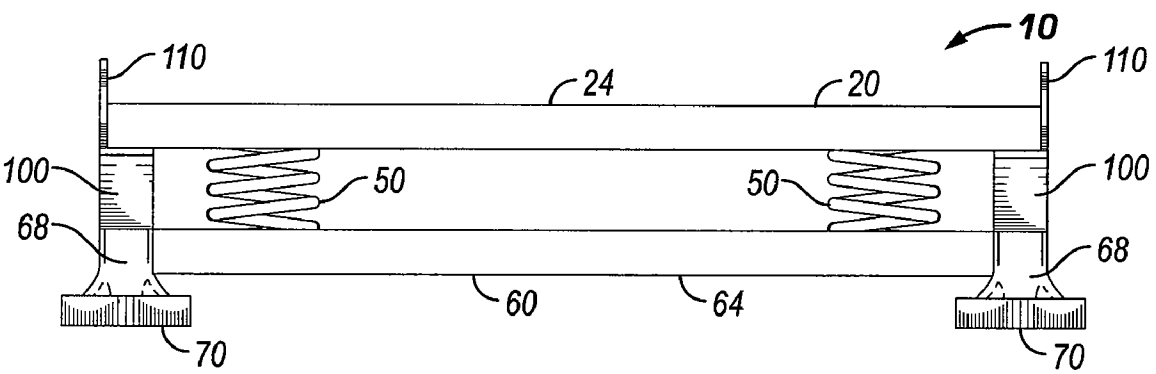
FIG. 5 illustrates a front elevation view of the embodiment shown in FIG. 1.

As shown in FIGS. 5 and 8, L-shaped side brackets 110 may be positioned so that the bottom portion of the "L" lays flat against cams 100. In addition, L-shaped side brackets 110 may be oriented with the vertical portion of the "L" positioned to the outside of each of the left and right sides, respectively, for ease of installation and assembly, and to promote maximum stability, of a rocker/recliner chair to rocker base 10. Thus, respective ends of upper U-shaped cross members 24 may rest on top of the bottom portion of the "L" of L-shaped side brackets 110 to permit maximum surface area exposed to welding upper U-shaped cross members 24 to L-shaped side brackets 110 thereby resulting in maximum rigidity of this connection.

To secure and anchor a rocker/recliner chair to rocker base 10, L-shaped side brackets 110 and side rails 68 may each contain a plurality of apertures 112 and 78, respectively, as best shown in FIG. 1, for receiving a plurality of fasteners.

While specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A rocker base for a rocker-recliner chair, comprising:

a lower frame comprising a plurality of lower U-shaped cross members connected to a plurality of side rails, and a plurality of lower spring mounts extending between and directly connected to respective inner side wall of the lower U-shaped cross members and connected to the side rails;

an upper frame comprising a plurality of upper U-shaped cross members connected to a plurality of L-shaped side brackets, and a plurality of upper spring mounts extending between the upper U-shaped cross members and connected to the L-shaped side brackets; and, a plurality of cams having an arcuate lower surface positioned against the side rails and a flat upper surface attached to the L-shaped side brackets, wherein the cams are compressibly loaded between the lower frame and the upper frame, wherein the upper spring mounts are inwardly offset from a vertical portion of the L-shaped side brackets to avoid a plurality of fasteners that join the cams to the L-shaped side brackets.

2. The rocker base of claim 1, wherein the upper U-shaped cross members and the lower U-shaped cross members comprise a U-shaped cross section from end to end and are formed as one of extrusions, stampings or roll-formings, wherein respective ends of the upper U-shaped cross members abut the vertical portion of the L-shaped side brackets, and wherein respective ends of the lower U-shaped cross members abut the side rails.

3. The rocker base of claim 2, wherein an open portion of the upper U-shaped cross members is oriented upward and away from the lower frame, and an open portion of the lower U-shaped cross members is oriented downward and away from the upper frame.

4. The rocker base of claim 1, wherein the upper spring mounts and the lower spring mounts each comprise a shallow tray comprising at least an inside wall, an outside wall, and an anchor panel, wherein an open end of the shallow tray is oriented upward and away from the lower frame for the upper spring mounts and downward and away from the upper frame for the lower spring mounts.

5. The rocker base of claim 1, further including a plurality of springs mounted to the upper and lower spring mounts for compressing the cams, wherein each of the upper and lower spring mounts comprise a plurality of apertures in an inside wall for receiving at least a portion of one coil of each of the plurality of springs, and a plurality of spring anchors conforming to the portion of the one coil for securing the plurality of springs to an anchor panel of each of the upper and lower spring mounts.

6. The rocker base of claim 5, further including a plurality of spring nubs formed in the anchor panel of each of the upper and lower spring mounts for secondary securement of the plurality of springs to the upper and lower spring mounts.

7. The rocker base of claim 6, wherein each spring comprises a coil direction, wherein the coil direction of each spring mounted in any one of the upper spring mounts is oriented in opposite directions from one another.

8. The rocker base of claim 1, further including a plurality of resilient shoes affixed to respective ends of the side rails.

9. The rocker base of claim 8, wherein each end of the side rails is crimped for receiving the resilient shoes and bent in the shape of an "S" from at least one view, to provide feet for supporting the rocker base.

10. The rocker base of claim 1, wherein the side rails are formed as one of extrusions, seamless tubes, or welded tubes.

11. The rocker base of claim 10, wherein the side rails form a closed cross section.

12. The rocker base of claim 11, wherein the cross section is one of approximately a square or approximately a rectangle.

13. The rocker base of claim 1, wherein the upper U-shaped cross members are longer than the lower U-shaped cross members.

14. The rocker base of claim 1, wherein the lower U-shaped cross members are welded to the side rails and to the lower spring mounts, and wherein the upper U-shaped cross members are welded to the L-shaped side brackets and to the upper spring mounts.

15. The rocker base of claim 1, wherein the cams comprise wood.

16. A rocker base for a rocker-recliner chair, comprising:

a plurality of lower U-shaped cross members, each having a U-shaped cross section and connected to a plurality of side rails for supporting the rocker base, and a plurality of lower spring mounts extending between and directly connected to respective inner side walls of the lower cross members and connected to the side rails;

a plurality of upper U-shaped cross members, each having a U-shaped cross section and connected to a plurality of L-shaped side brackets, and a plurality of upper spring mounts extending between the upper cross members and connected to the L-shaped side brackets; and a plurality of cams having an arcuate lower surface positioned against the side rails and a flat upper surface attached to the L-shaped side brackets, wherein the cams are compressibly loaded between the side rails and the L-shaped side brackets, wherein the upper spring mounts comprise a shallow tray having four side walls and a bottom, the upper spring mounts being inwardly offset a distance from a vertical portion of the L-shaped side brackets.

17. The rocker base of claim 16, wherein the upper U-shaped cross members and the lower U-shaped cross members are extrusions, wherein respective ends of the upper U-shaped cross members are open and abut the vertical portion of the L-shaped side brackets, and wherein respective ends of the lower U-shaped cross members are open and abut the side rails.

18. A rocker base for a rocker-recliner chair, comprising:

a first side rail, a second side rail, a first cross member, and a second cross member, wherein the first cross member and the second cross member extend between the first and second side rails, and a plurality of lower spring mounts extending between and directly connected to respective inner side walls of the first and second cross members, each of the plurality of lower spring mounts comprising an inside wall configured to receive a plurality of first springs, a forward wall connected to the first cross member, an aft wall connected to the second cross member, and an outside wall connected to one of the first and second side rails;

a first L-shaped side bracket, a second L-shaped side bracket, a third cross member, and a fourth cross member, wherein the third cross member and the fourth cross member extend between the first and second L-shaped side brackets, and a plurality of upper spring mounts, each comprising an inside wall configured to receive a plurality of second springs, a forward wall connected to the third cross member, an aft wall connected to the fourth cross member, and an outside wall spaced apart from a vertical wall of the first and second L-shaped brackets and connected to an edge of the first and second L-shaped side brackets, and a plurality of cams having an arcuate lower surface positioned against one of the first and second side rails and a flat upper surface attached to one of the first and second L-shaped side brackets, wherein the cams are compressibly loaded between the side rails and the L-shaped side brackets.

19. The rocker base of claim 18, wherein the first and second cross members comprise an extrusion having a U-shaped cross section with open ends connected to the first and second side rails, and wherein the third and fourth cross members comprise an extrusion having a U-shaped cross section with open ends connected to the first and second L-shaped side brackets.

20. The rocker base of claim 18, wherein the upper and lower spring mounts comprise shallow trays.

* * * * *

UNITED STATES PATENT AND TRADEMARK OFFICE

CERTIFICATE OF CORRECTION

PATENT NO. : 7,628,452 B2
APPLICATION NO. : 12/040822
DATED : December 8, 2009
INVENTOR(S) : Guoliang Du et al.

It is certified that error appears in the above-identified patent and that said Letters Patent is hereby corrected as shown below:

Claim 4, Column 6, Line 63 delete "wall" and replace with --walls--.

Signed and Sealed this

Nineteenth Day of January, 2010

David J. Kappos

David J. Kappos
*Director of the United States Patent and Trademark Office*